US005099534A

United States Patent [19]

Annen et al.

[11] Patent Number: 5,099,534

[45] Date of Patent: Mar. 31, 1992

[54] CONTINUOUS DYEING PROCESS

[75] Inventors: Oskar Annen, Aesch; Ernst Schnider, Füllinsdorf; Franz Somm, Riehen, all of Switzerland

[73] Assignee: Sandoz, Ltd., Basel, Switzerland

[21] Appl. No.: 471,160

[22] Filed: Jan. 26, 1990

[30] Foreign Application Priority Data

Jan. 27, 1989 [DE] Fed. Rep. of Germany ..... 3902365
Mar. 18, 1989 [DE] Fed. Rep. of Germany ..... 3908949

[51] Int. Cl.[5] ..... D06B 1/10; D06B 11/00; B05C 1/16

[52] U.S. Cl. ..... 8/149; 8/151; 8/158; 68/200; 118/211; 118/225; 118/264; 427/280; 427/288

[58] Field of Search ..... 8/149, 150, 151, 158; 68/29, 200; 427/280, 288; 118/211, 222, 264

[56] References Cited

U.S. PATENT DOCUMENTS 4,841,751 6/1989 Ricci ..... 68/29

*Primary Examiner*—Philip R. Coe
*Attorney, Agent, or Firm*—Gerald D. Sharkin; Richard E. Vila; Thomas C. Doyle

[57] ABSTRACT

The invention relates to a process of preparing "one off effect" dyeings on paper or textile material comprising:

passing (preferably drawing) the material continuously through an application zone containing a number of loosely-packed applicator elements, which elements contact and can apply treatment medium to the material in response to the motion of the material, the applicator elements being continuously or intermittently contacted with a treatment medium (preferably a solution containing a dyestuff or etching compound), whereby the "one off effect" is produced by the passage of the material under or through the elements, onto which the medium has been applied.

27 Claims, 2 Drawing Sheets

CONTINUOUS DYEING PROCESS

The invention relates to a process for preparing "one off effect," i.e. random dyeings on paper or textile material comprising:

passing (preferably drawing) the material continuously through an application zone containing a number of loosely-packed applicator elements, which elements are adapted to contact and apply a treatment medium to the material in response to the motion of the material, the applicator elements being continuously or intermittently contacted with said treatment medium (preferably a solution containing a dyestuff or etching compound), whereby the "random dyeing" is produced by the passage of the material under or among the elements, onto which the medium has been applied.

Preferably the rate at which the material passes through the application zone is from 1 to 40 meters per minute, more preferably 5 to 15 meters per minute, most preferably 6 to 12 meters per minute.

Preferably the applicator elements are plastic pieces, wood pieces or more preferably stone pieces, e.g. natural stone pieces, for example pumice stone pieces, having a particle size of on average 1 to 6 cm. The applicator elements preferably have a certain degree of porosity and must be able to retain treatment medium thereon until it is removed by contact with the paper or textile material. The applicators need to be porous, that is to say preferably be able to take up 0.2 to 25 ml of treatment material per 100 $cms^2$ of applicator elements.

By the term "etching" is meant chemical bleaching.

Preferably the treatment medium is poured, sprayed or dropped onto the applicator elements during passing of the material.

Preferably in a process according to the invention, when the treatment medium is a dye-containing medium, the dyes used are disperse, basic, direct or acid dyes, or particularly reactive dyes in an aqueous liquor, preferably in an amount of 10 to 50 g per liter.

Preferably when the treatment medium is an etching compound containing medium, this is preferably a chlorite solution, more preferably sodium hyprochlorite. Preferably the etching compound is used in an aqueous solution in an amount of 50 to 200 g per liter.

Further according to the invention there is provided an apparatus for dyeing or etching a material to form a "random dyeing" comprising:

a) a zone containing loosely packed applicator elements (preferably stone pieces) for applying a dyestuff- or etching compound-containing treatment medium to a material passing through the zone, the applicator elements being adapted to lie on the material;

b) means for causing the material to pass through the zone; and c) means for introducing dyestuff or etching compound onto the applicator elements by pouring, dripping or spraying said medium thereon.

Preferably means c) comprises one or more heads located above the applicator elements.

Preferably the zone is a trough, defined by a base having a sieve portion through which excess treatment medium can pass, the base being inclined at an angle of from 15° to 50° and having two side wall pieces that are attached to the base or communicate sealingly with the base to retain the applicator elements within the trough.

The trough preferably has a wall located downstream of the trough with respect to the motion of the material to maintain the applicator elements in the trough.

For the avoidance of doubt, the term "stone pieces" is meant to include naturally occurring pebbles or stones.

The invention can be performed on an apparatus as shown in FIGS. 1 or 2 following.

Figure 1:
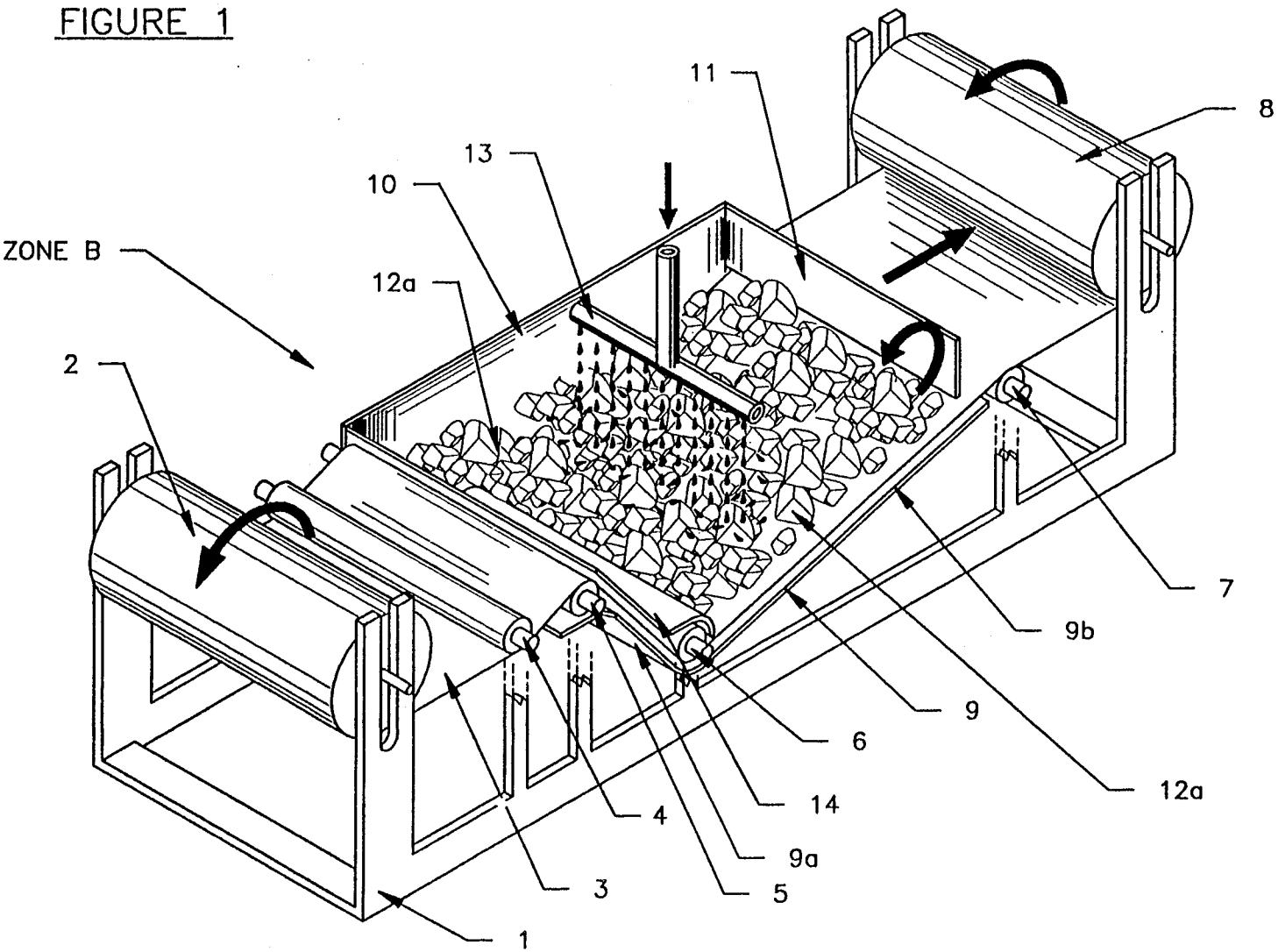
FIG. 1 shows a perspective view of an apparatus for performing a process according to the invention.

In FIG. 1, a perspective view of an apparatus for performing the method of the invention is shown. The apparatus comprises a preferably rectangular frame 1 having transverse horizontal rollers 2 and 8 rotatably mounted thereon at opposite ends. Transverse horizontal relay rollers 4, 5, 6 and 7 are disposed, in that order, between rollers 2 and 8 and may also be rotatably mounted on frame 1. Roller 6 is lower than rollers 5 and 7. The motion of rollers 2 and 8 can be regulated by driving means (not shown).

Transverse guide 9*a* extends from roller 5 to just below roller 6 and transverse guide 9*b* extends from just below roller 6 to roller 7. Preferably rollers 6 and 7 are so disposed with respect to each other that the guide 9*b* which is flat straight piece between them will form an elevation of 10° to 55°, more preferably 15° to 40° from the horizontal. These guides, which may be joined below roller 6, may be connected to frame 1 or may be suspended from rollers 5, 6 and 7. Guide 9*b* is perforated to form a sieve. Guides 9*a* and 9*b* comprise the bottom of a trough 9 which is further defined by side walls 10 (only one of which is shown) and transverse end wall 11. Walls 10 extend from guide 9*a* to wall 11 and may constitute an integral part of or be connected to frame 1 or may be connected to guides 9*a* and 9*b*. Wall 11 is slidably connected to walls 10 to permit raising and lowering of wall Applicator elements 12*a* (preferably pumice stones) are adapted to be loosely disposed in trough 9 on top of a length of textile material 3 to be treated therein. Said elements 12*a* are employed in sufficient amount to cover the lower portion of trough 9 from side wall to side wall.

A transverse head member 13, which preferably is connected to frame 1, is situated above trough 9 in such manner that a treatment liquor sprayed, poured or dripped therefrom will contact the applicator elements 12*a* in trough 9. Head member 13 is also connected to a suitable source of treatment liquor by conventional means (not shown), which also includes conventional means, e.g. a valve, for controlling the flow rate of the treatment liquor.

A transverse cover 14, which is connected to side walls 10, is disposed to overlie roller 6 and prevent contact between roller 6 and applicator elements 12*a*.

According to the process of this invention a length of textile material 3 to be treated is wound on roller 2 and is drawn therefrom under roller 4, over roller 5, under roller 6, over roller 7 and onto roller 8, whereby it is caused to pass through trough 9. The material 3 is tensioned so as to pass just over guides 9*a* and 9*b*. Applicator elements 12*a* are disposed on top of the textile material where it passes through trough 9. The end wall 11 is raised to a height sufficient to allow passage of the textile material thereunder, but to prevent passage of any applicator elements 12*a*.

When the leading end of the textile material 3 is connected to roller 8 and the applicator elements are in place continuous movement of the material from roller 2 to roller 8 is begun along with spraying, pouring or dripping of the treatment liquor from head 13 onto applicator elements 12*a* in Treatment Zone B. The motion of the material causes the individual elements 12*a* to roll over each other and contact various portions of the surface of the textile material whereby a "random pattern" is produced. Applicator elements which are drawn along with the material to wall 11 are stopped by said wall and are caused to roll back into the lower portion of the trough by gravitational forces due to the incline from roller 6 to roller 7, as shown by arrow 11 in FIG. 1. When the desired amount of material has been treated, it may be removed from roller 8 and further treated in conventional manner as desired, e.g. drying, fixation and/or washing.

Figure 2:
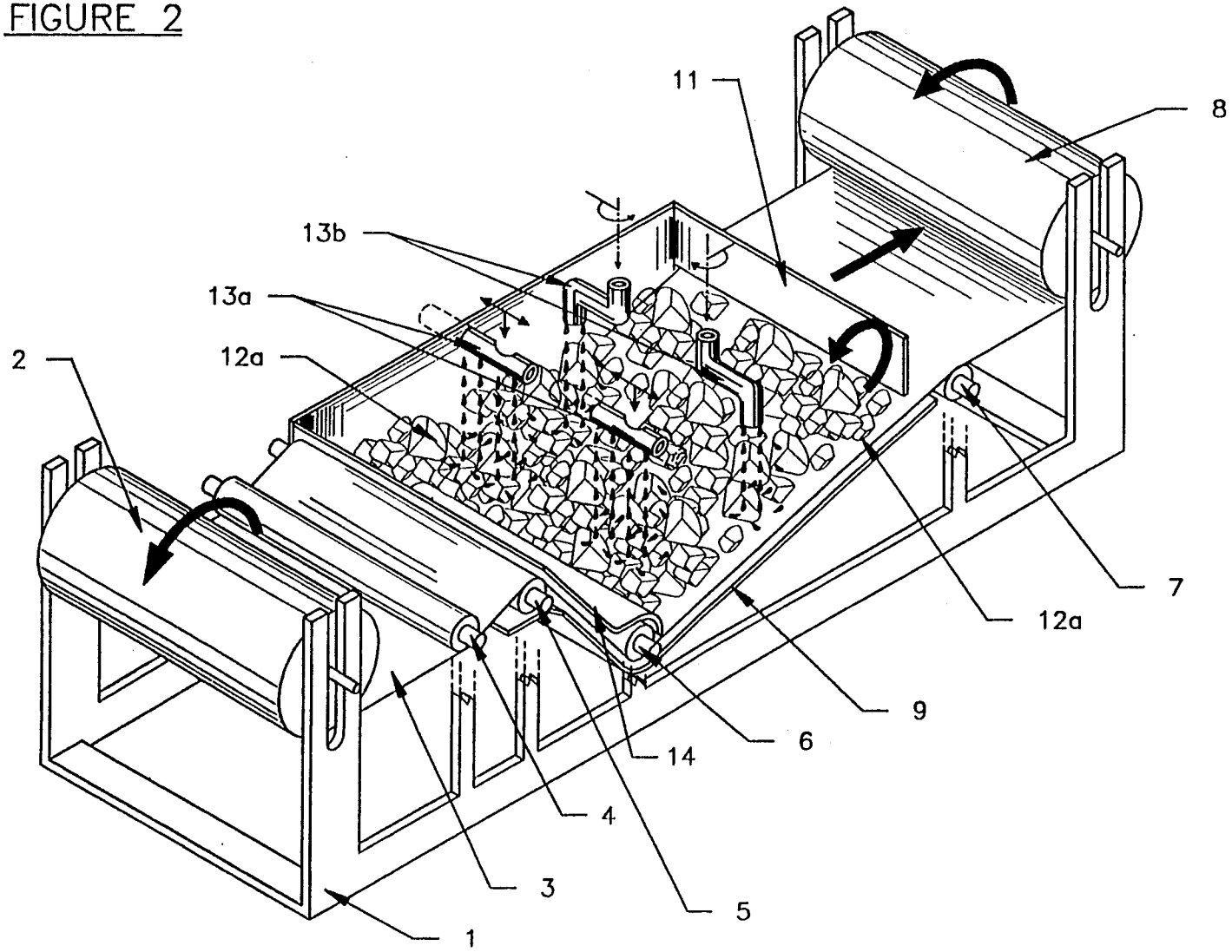
FIG. 2 shows a similar apparatus with a different application mechanism for the treatment medium onto the applicator elements.

FIG. 2 differs from FIG. 1 in that instead of having a single head 13 to apply the medium to elements 12*a*, two heads 13*a* and 13*b* are shown which may be used to apply two different dyeing solutions to the elements 12*a* depending on what effect is desired on the material. The heads 13*a* and 13*b* may be rotatable or may be laterally displaceable with respect to the direction of motion of the material passing through the treatment zone.

The apparatus of FIGS. 1 or 2 can be varied as follows.

1. It is possible for the material to pass through a number of treatment zones similar to Zone B.
2. It is possible to insert an additional device between wall 11 and roller 8 for drying, steaming or otherwise further treating the material.
3. It is also possible to insert a device upstream of trough 9 to wet the material before it passes through Zone B in order to make the designs softer if desired or to apply chemicals to enhance the dyeability of the material being treated.
4. A further possibility to produce an aquarelle type effect is to pass the fabric after applying a water-soluble dyestuff thereto through the nip of a padding apparatus. The material in such a case can be wetted, with 40 to 60% by weight of the material being so treated with water. By such a treatment a soft and wavy contour pattern on the material results.

The most important advantages of the process according to the invention are as follows:

1) It is possible to produce indirect dyeing effects by means of the applicator elements.

2) By using a large number of applicator elements (e.g. pumice stones) it is possible to produce a number of "random dyeing" patterns.

3) By regulating the amount of dyestuff or etching compound applied to the application elements for example with a dosing pump and by regulating the speed of the material passing through the treatment zone, it is possible to produce any type of pattern (e.g. the production of broken fine lines or broader lines) by regulation of these two parameters.

4) By judicious choice of the form, weight, texture and/or size of the applicator elements, special effects can be obtained. For example, by using elements of appropriate mass and roughness of surface, such as pumice stone, it is possible to simultaneously abrade the surface of a textile material, such as cotton, to obtain, to a somewhat lesser extent, the effect of "stone washing".

5) Further specific effects can be produced by the choice of the substrate (shown in the apparatus as material 3) in particular depending on the absorption capacity and the retention of water capacity of the material.

It is usual to dissolve or disperse the dyestuffs and/or chemicals used in the treatment process in water and apply them to the applicator elements from an aqueous medium. The viscosity of such solutions or dispersions can be increased by conventional additives, and this can effect the pattern on the fabric. Such additives include wetting agents. However the dyestuffs can also be dissolved in a solvent that can be taken up on the fabric, which is of interest for synthetically produced fabric materials.

The process of this invention can be used to dye any textile material dyeable with disperse, basic, direct, acid, or reactive dyes, especially cellulosic materials and polyester. The material may be undyed or (as where etching is to be effected) dyed. For etching the textile material may be any which is not adversely affected by the bleaching compound and which is dyeable with a bleachable dye.

The combination of the process according to the invention with other coloring techniques (e.g. continuous dyeing and printing processes) opens up the possibility of a variety of new effects to be produced.

EXAMPLES

The invention will now be illustrated by the following examples in which all temperatures are in degrees centigrade and all parts and percentages are by weight.

Example 1

A mercerized and bleached cotton twill fabric having a weight per square meter of 220 grams is treated on the apparatus of FIG. 1 as follows.

The rate of drawing the material through the trough 9 is 8 meters per minute. The applicators 12*a* are pumice stones present in an amount of 1.5 kg per 10 cm of trough width. The pumice stones are naturally occurring stones with an average particle size of 2–3 cm which have not had any special treatment. The width of the trough between walls 10 is 1.5 m. An aqueous dyestuff solution is applied to these stones by dripping from of head 13. The dyestuff solution is as follows:

20 g/l of C.I. Reactive Red 147
12 g/l of Sodium bicarbonate and
150 g/l of Urea By using a dosing machine, the amount of dyestuff applied to the pumice stones is 800 ml/min. As the material passes under wall 11 from the zone B, the substrate shows a finely structured one off effect pattern. The material is then rolled up on roller 8 at the end of the dyeing process and taken to a fixing machine (Fixing Machine Type TKF from Fa. BENZ). The material is unrolled and the reactive dyestuff is fixed at 160° for 2 minutes. Finally the material is washed in demineralized water (both cold and hot) and soaped off with 1 g/l of an anionic active washing material at the boil. After drying, a fine structured "random dyeing" clearly visible pattern of the rolling pumice stones can be seen. Example 1 is repeated using pumice stones with an average size of 4–6 cm. In this way a random pattern with a totally different character can be produced.

Example 2

A cotton fabric with a square meter weight of 200 g is, using a Pad-Dry-Thermofixation process, continuously dyed as follows:

Padding is carried out on a Benz-Padding Apparatus with an aqueous solution comprising 20 g/l C.I. Reactive Blue 104,
30 g/l C.I. Red 159,
12 g/l of Sodium bicarbonate and
150 g/l of urea.

The take up is 55% based on the dry weight of the substrate. Drying and fixing are carried out on Benz Laboratory Fixing Machine (Type TKF as above) for 2 minutes at 160° C. Finally the dyeing was washed and soaped off with 1 g/l of an anionic active washing medium as above. After drying, a violet dark dyeing was produced and treated on the apparatus of FIG. 1 as follows:

The rate of drawing material through the apparatus is 8 m/min. The amount of pumice stones is 1.2 kg per 10 cm trough width, the pumice stones having an average size of 2–3 cm. The width of the trough is 1.5 m as in Example 1. By means of dosing apparatus a sodium hypochlorite solution at 20° C. having an active chlorine content of 15 g/l is dosed at 1 l/min. into the trough through the head 13. The sodium hypochlorite solution is applied to the fabric and causes a fine irregular pattern to be produced after the material has left the treatment zone B. The treated material is rolled on to a roller 8 over 45 min. and stored for 45 min. It is then washed with water and then soaped off with 1 g/1 of an anionic active washing medium and 0.5 g/l of soda. The fabric is then dried.

By this chlorination treatment, a part of the chlorine unstable reactive dye can be destroyed. This treatment can be used to produced a marmor type of pattern with a very fine structure. Example 2 can be repeated using a second treatment with chlorine with the same parameters as in Example 2 above followed by washing and soaping off again. A very clear marmor type pattern with various dyes results. Example 2 can be repeated after dyeing by a pad-steam process with 100 g/l of C.I. Leuco Sulphur Blue 15 (53540) and 50 g/l C.I. Leuco Sulphur 36 in the same way as described in Example 2 above, followed by treatment with the sodium hypochlorite solution. After washing and soaping off, a very clear marmor type pattern is produced. In this dyeing, the dyestuff that is unstable in the presence of chlorine is clearly differentiated or in part destroyed by the sodium hypochlorite solution to give a "random pattern dyeing".

Example 3

A polyester fabric of Dacron 56 (dry) is treated on the apparatus of FIG. 1 as follows:

The rate of transport of the material through the trough 9 is 6 m per minute and the amount of pumice stones used is 1.4 kg per 10 cm of trough 9. The width of the trough is 1.5 m. By means of a dosing apparatus, 500 ml per minute of a dyestuff medium containing 30 g/l of C.I. Disperse Blue 354 is dropped on to the pumice stones from a head 13. By means of the pumice stones, the dyestuff medium is applied into the polyester material. After dyeing, the material is rolled up on roller 8. It is subsequently unrolled and is treated in a "Thermosol" process as follows. Drying is carried out on the Benz Laboratory Fixer of Example 1 and "Thermosol" treatment of the disperse dyestuff is carried out at 200° C. for 2 minutes. After reductive clearance, the material is dried. A brilliant blue pattern of a fine "random dye effect" results.

Example 4

A mercerized and bleached cotton fabric having a square meter weight of 220 g (dry) is treated on the apparatus of FIG. 2. Two different dyeing mediums are applied to the fabric prior to fixing. The first dyeing medium is 25 g/l C.I. Reactive Blue 116, 12 g/l sodium carbonate and 150 g/l of urea and the second dyeing medium is 25 g/l C.I. Reactive Yellow 25, 12 g/l sodium bicarbonate and 150 g/l urea. Application of both is by dripping.

The rate of drawing the material through the trough is 7 m/min. and the amount of pumice stones used is 1.2 kg/10 cm of trough, the trough 9 being 1.5 m wide. The pumice stones have the average size of 2–3 cm. 500 ml/min. of each dye solution is dosed through head 13*a* and 13*b* respectively, one after the other. This produces a multicolor fine structured marmor type "random dyeing effect" pattern.

The fabric is then passed through the nip of a padding machine whereby the nip wets the material with water. The fabric then produces a light smearing of the contours of the pattern on the material. Finally after wet treatment, the fabric is dried on a laboratory dryer as described in Example 1 and fixed on a Benz Laboratory Fixer at 160° for 2 minutes. After washing and soaping off, a pattern is produced which has aquarelle affect. This special effect occurs due to the application of water after the dyeing solutions.

What is claimed is:

1. A process for producing a random dyeing on paper or textile material which comprises passing the material continuously along an inclined path through an application zone containing a number of loosely-packed applicator elements which contact and can apply a treatment medium to the material in response to the motion of the material and thence under an end wall, which is disposed to allow passage of the material thereunder but to prevent passage of applicator elements, whereby applicator elements which are drawn along with the material are stopped by the wall and caused by gravitational forces to roll backwards relative to the direction of movement of the material, and continuously or intermittently introducing onto said applicator elements in said application zone a treatment medium containing a dyestuff or a chemical bleaching compound, whereby the random dyeing is produced by the passage of the material under the elements onto which the treatment medium has been applied.

2. A process according to claim 1 in which the rate that the material passes through the application zone is from 1–40 meters per minute.

3. A process according to claim 1 in which the applicator elements are stone pieces.

4. A process according to claim 3 in which the applicator elements are pumice stone pieces, having a particle size of on average 1–5 cm.

5. A process according to claim 1 in which the treatment medium is poured, sprayed or dropped onto the applicator elements.

6. A process according to claim 1 in which the treatment medium is a dye containing medium and the dyes used are reactive or disperse dyes in a aqueous liquor.

7. A process according to claim 6 in which the dyes used are reactive dyes in an amount of 10–50 g per liter.

8. A process according to claim 1 in which the treatment medium is a chlorite solution.

9. A process according to claim 8 in which the chlorite solution is sodium hyprochlorite, in aqueous solution in a ratio of 50:200 g per liter.

10. A process according to claim 1 wherein the applicator elements are plastic, wood or stone pieces having sufficient porosity to take up 0.2 to 25 ml of treatment material per 100 $cms^2$ of applicator elements.

11. A process according to claim 1 wherein the material is a textile material.

12. A process according to claim 1 wherein the applicator elements lie on top of the material and are caused to roll over each other and contact various portions of the surface of the material by the motion of the material.

13. A process according to claim 1 which comprises continuously drawing a length of textile material from a first roller, through an application zone, onto a second roller, said material having disposed thereon, in said application zone, applicator elements comprising porous pieces of plastic, wood or stone which are caused, by the motion of the material, to roll over each other and contact various portions of the surface of the textile material and continuously or intermittently spraying, pouring or dripping a treatment liquid containing a dyestuff or a chemical bleaching compound onto the applicator elements in the application zone, whereby a random dyeing pattern is produced on the textile material by removal of the treatment liquor from the applicator elements on contact with the material.

14. A process according to claim 13 wherein treatment liquor is an aqueous liquor containing a disperse, basic, direct, acid or reactive dye.

15. A process according to claim 14 wherein the applicator elements are stone pieces.

16. A process for producing a random dyeing on paper or textile material which comprises drawing the material under tension from a first roller, through an application zone containing a number of loosely-packed applicator elements which contact and can apply treatment medium to the material in response to the motion of the material, under an end wall to a second roller which is elevated with respect to said first roller, whereby applicator elements which are drawn along with the material are stopped by the wall and caused to roll backwards relative to the direction of movement of the material, and continuously or intermittently introducing onto said applicator elements in said application zone a treatment medium containing a dyestuff or a chemical bleaching compound, whereby the random dyeing is produced by the passage of the material under the elements onto which the treatment medium has been applied.

17. A process according to claim 16 wherein the treatment medium is an aqueous liquor containing a disperse, basic, direct, acid or reactive dye.

18. An apparatus for dyeing or chemically bleaching a paper or textile material to produce a random pattern which comprises:

a) a zone adapted to contain loosely packed applicator elements for contacting said material and applying thereto a treatment liquor containing a dye or chemical bleaching compound;

b) means for causing the material to pass through the zone, said means including first and second transverse horizontal rollers, said rollers being so disposed with respect to each other that said first roller is lower than said second roller so that a length of said paper or textile material passing under tension from said first roller to said second roller will be at an incline; and c) means for pouring, dripping or spraying the treatment liquor onto the applicator elements in said zone.

19. An apparatus according to claim 18 wherein zone a) contains the loosely packed applicator elements.

20. An apparatus for dyeing or chemically bleaching a paper or textile material to produce a random pattern, said apparatus comprising a frame, first and second transverse horizontal rollers rotatably mounted on said frame at opposite ends thereof, third, fourth and fifth transverse horizontal rollers disposed in that order between said first and second rollers, said fourth roller being lower than said third and fifth rollers, a first transverse guide extending from said third roller to just below said fourth roller, a second transverse guide extending from just below said fourth roller to said fifth roller, a transverse end wall, and side walls extending from said first transverse guide to said end wall, said transverse guides comprising the bottom of a trough defined by said bottom and by said end wall and side walls, said trough constituting a zone a), and said rollers comprising the means for causing the paper or textile material to pass through said zone a), and said apparatus further comprising loosely packed applicator elements in said zone a) for contacting said material and applying thereto a treatment liquor containing a dye or a chemical bleaching compound, and means for pouring, dripping or spraying the treatment liquor onto the applicator elements in zone a).

21. An apparatus according to claim 20 wherein means c) is situated above the trough which comprises zone a).

22. An apparatus according to claim 21 wherein the rollers are adapted to draw the material from the first roller to the second roller below but in contact with the applicator elements.

23. An apparatus according to claim 21 wherein the second transverse guide forms an elevation of 10° to 55° from the horizontal.

24. An apparatus according to claim 21 wherein the end wall is slidably connected to the side walls in a manner to permit raising and lowering of said end wall.

25. An apparatus according to claim 21 wherein the applicator elements are porous pieces of plastic, wood or stone.

26. An apparatus according to claim 29 wherein the applicator elements have an average size of 1 to 6 cm.

27. An apparatus according to claim 20 wherein the rollers are adapted to draw the material from the first roller to the second roller below but in contact with the applicator elements.

* * * * *